US005787627A

United States Patent [19]

Snoke et al.

[11] Patent Number: 5,787,627

[45] Date of Patent: *Aug. 4, 1998

[54] SOFT, PLIABLE PICTURE FRAME AND METHOD OF FRAMING A PICTURE

[75] Inventors: Phillip Jack Snoke; Mark J. Moneypenny; Edward Stamm, Jr., all of Atlanta, Ga.

[73] Assignee: American Industrial Design Co., Inc., Atlanta, Ga.

[ * ] Notice: The term of this patent shall not extend beyond the expiration date of Pat. No. 5,581,925.

[21] Appl. No.: 762,067

[22] Filed: Dec. 9, 1996

Related U.S. Application Data

[63] Continuation-in-part of Ser. No. 336,992, Nov. 14, 1994, Pat. No. 5,581,925.

[51] Int. Cl.[6] ..... A47G 1/06

[52] U.S. Cl. ..... 40/791; 40/753; 40/755; 40/746

[58] Field of Search ..... 40/753, 748, 755, 40/756, 746, 757, 768, 765, 798, 791

[56] References Cited

U.S. PATENT DOCUMENTS

| | | | |
|---|---|---|---|
| 1,904,318 | 4/1933 | Lehere . | |
| 2,373,874 | 4/1945 | Cross | 40/768 X |
| 2,647,834 | 8/1953 | Rabkin et al. . | |
| 3,200,526 | 8/1965 | Munn . | |
| 3,835,562 | 9/1974 | Thistlewaite et al. . | |
| 4,809,451 | 3/1989 | Suzuki | 40/798 X |
| 5,524,370 | 6/1996 | Roy | 40/768 X |
| 5,577,609 | 11/1996 | Hexter, Jr. . | |
| 5,581,925 | 12/1996 | Snoke et al. . | |

*Primary Examiner*—Blair Johnson

*Attorney, Agent, or Firm*—Allen Dyer Doppelt Milbrath & Gilchrist

[57] ABSTRACT

A picture frame and frame assembly are provided which preferably includes a transparent sheet defining picture covering, a picture positionally aligned adjacent the picture covering for viewing therethrough, and a backing sheet member positioned to underlie back portions of the picture and to support front portions of the picture against the picture covering, and a frame body integrally formed from a unitary piece of a soft, pliable material. The frame body of the invention preferably has a front portion which includes a first opening formed therein arranged for viewing a picture therethrough and a back portion which includes a second opening formed therein positionally aligned with the first opening. The second opening receives the picture covering, the picture, and the backing sheet member therein. The back portion also includes a flexible peripheral lip surrounding the second opening and encasing a detachably securing peripheral portions of the picture covering, the picture, and the backing sheet member within the second opening and between the shoulder and the lip. Methods of framing a picture for protecting a frame from damage and for detachably securing a picture within the confines of a frame are also provided.

12 Claims, 5 Drawing Sheets

SOFT, PLIABLE PICTURE FRAME AND METHOD OF FRAMING A PICTURE

RELATED APPLICATIONS

This application is a continuation-in-part of U.S. patent application Ser. No. 08/336,992 filed on Nov. 14, 1994, now issued on Dec. 10, 1996 as U.S. Pat. No. 5,581,925 and is hereby incorporated herein in its entirety.

FIELD OF THE INVENTION

This invention relates to framed pictures such as photographs, illustrations, and various other artwork and, more particularly, to a framed picture constructed for protecting a frame and/or its contents thereof.

BACKGROUND OF THE INVENTION

Picture frames are typically used to decoratively frame and display a picture such as a photograph, illustration, or various other artworks for viewing. A picture frame is generally placed on a desk, table, or shelf and includes a stand for holding the picture frame upright. The picture may also be hung on a wall or other mounting surface. The picture to be framed may often include a picture covering for protecting a picture, a picture, and a relatively rigid backing member for supporting the picture in the frame.

Conventional picture frames have been developed formed from elongate members of wood often arranged in a rectangular shape which requires that the frame be constructed often with glue and fasteners to secure mitered corners of the elongate wood members in the rectangular shape. The construction of the wood frame usually occurs prior to the mounting of a picture covering, matting material, a picture, and backing material. These conventional framed pictures, however, require complex and time consuming assembly or mounting and are quite fragile when knocked off a wall or knocked over on a desk or table.

Picture frames also have been formed from a variety of other materials including metal, other hardened plastic materials, and the like, see e.g., U.S. Pat. No. 4,939,858 by Dailey titled "Picture Framell and U.S. Pat. No. 1,904,318 issued Apr. 18, 1933 by Lehere titled "Frame." To produce relatively inexpensive frames, it is known to integrally form the picture frame to reduce the number of machining and/or assembly operations required after fabrication. These integrally formed picture frames, however, generally require additional retaining elements to secure a picture to be framed within the confines of the frame. These retaining elements also often make the assembly process complex and time consuming and may not adequately secure a picture covering, a picture, and a backing member within the confines of the frame. It is also desirable for a picture frame to be decorative because it is often positioned on a desk, a table, or a shelf so that it is readily visible and accessible. Their accessibility, however, presents another problem which is common to metal, wood, and hard plastic picture frames. The frame can be damaged if dropped to the floor or knocked over on a desk or shelf. Even if the frame itself is not damaged when it is dropped or knocked over, it can transfer the force of the impact and damage the transparent picture covering (conventionally made of glass or hard plastic), the frame, and/or the picture positioned in the frame. A wood, metal, or hard plastic picture frame can also damage the floor if dropped, or-the surface of a fine desk or table if knocked over. Additionally, if the framed picture is dropped or knocked over, the retaining elements of the frame are also often disengaged or managed thereby requiring reassembly of the framed picture or another picture frame.

OBJECTS AND SUMMARY OF THE INVENTION

It is accordingly an object of the present invention to provide a framed picture constructed for protecting a frame and a picture covering positioned therein from damage such as when knocked over on a desk or table.

It is also an object of the present invention to provide a picture frame which is integrally formed of a unitary piece of soft, pliable material.

It is additionally an object of the present invention to provide a method of framing a picture for protecting a frame from damage and for detachably securing a picture within the confines of a frame.

It is another object of the present invention to provide a picture frame that easily and readily mounts pictures therein.

It is still another object of the present invention to provide a picture frame that is relatively inexpensive to manufacture and has a variety of attractive styles and appearances for various applications.

It is a further object of the present invention to provide a picture frame that reduces the number of framing pieces necessary for framing a picture.

More particularly, a framed picture according to the present invention preferably has a transparent sheet refining a picture covering, a picture positionally aligned adjacent the picture covering for viewing therethrough, a backing sheet member positioned to underlie back portions of the picture and arranged for supporting front portions of the picture against the picture covering, and a frame body integrally formed from a unitary piece of a soft, pliable material such as an elastomer or foam.

Because the picture frame advantageously is integrally formed of a unitary piece of a soft, pliable material, the frame body generally may be deformed by stretching, twisting, or bending for ease of assembly and with a minimal number of parts thereof. To frame a picture according to an embodiment of the present invention, for example, the flexible peripheral lip surrounding the second opening is deformed sufficiently so that the picture covering, the picture, and the backing sheet member may be inserted between the first and second openings of the frame body. After the picture covering the picture, and the backing sheet member are inserted into the picture frame, the flexible peripheral lip is released so that it returns to its relaxed, non-deformed position. The framed picture then may be positioned on a desk, table, shelf, or wall so that the picture may be viewed.

The frame body according to the present invention preferably has front and back portions thereof. The front portion preferably includes a first opening formed therein positioned to view a picture therethrough. The back portion preferably includes a second opening formed therein positionally aligned with the first opening and receiving the picture covering, the picture, and the backing sheet member therein. In a first embodiment, the second opening preferably has a larger circumference than the first opening so that peripheral portions of the body surrounding the first opening and positioned between the first and second openings define a shoulder to position peripheral portions of a picture covering thereagainst so that a picture positioned against the picture covering is viewable from the front portion of the frame body. The back portion preferably also includes a flexible peripheral lip surrounding the second opening, positionally aligned with and spaced rearwardly from the shoulder, and encasing and detachably securing peripheral portions of the picture covering, the picture, and the backing sheet member within the second opening and between the shoulder and the lip.

In another embodiment, the first and second opening may be of substantially the same size so that either individually or any combination of peripheral portions of a picture covering, a picture, or a backing member may be received therein.

In yet another embodiment, a picture frame assembly according to the present invention is provided which includes a frame body integrally formed from a unitary piece of soft, pliable foam material. The frame body has front and back portions thereof and an opening formed therein which extends from the front portion to the back portion thereof. The back portion has a flexible peripheral lip surrounding the opening. A backing member has peripheral portions thereof inserted into the frame body for supporting a picture to be view through the opening from a front portion thereof. The backing member includes backing member slippage inhibiting means connected to peripheral edges of said backing member for inhibiting slippage of peripheral portions of the backing member when positioned within the frame body.

Methods of framing a picture for protecting a frame positioned therein from damage such as when knocked over on a desk or table and for detachably securing a picture within the confines of a frame are also provided by the present invention. A method preferably includes encasing peripheral portions of a picture within the confines of a picture frame integrally formed of a unitary piece of a soft, pliable material and which includes an opening formed in a front portion thereof so that front portions of the picture correspondingly are viewable through the opening in the front portion of the soft, pliable picture frame.

Another method preferably includes providing a frame body integrally formed of a unitary piece of a soft, pliable foam material and which includes front and back portions. The front portion has a first opening therein and the back portion has a second opening therein positionally aligned with the first opening. Peripheral portions of a lip of the frame body surrounding the second opening of the back portion preferably are deformed, and a picture such as a photograph, illustration, or other various artworks is inserted into the second opening so that peripheral portions of the picture are encased within the confines of the frame body between the first and second openings formed therein.

Yet another method of framing a picture preferably includes providing a frame body integrally formed of a unitary piece of a soft, pliable elastomeric material and deforming a flexible peripheral lip of the frame body surrounding an opening in a back portion thereof. Peripheral edge portions of a backing member which includes a slippage inhibitor formed integrally therewith are inserted into the inner confines of the frame body.

These embodiments of a picture frame and frame assembly advantageously provide a secure holding of the picture and backing member within the frame body and advantageously allow the frame body to accommodate a large variety of framed materials. Also, this construction and arrangement can allow matting material or other intermediate backing material for the picture to be eliminated. This advantageously can save costs and provide a less expensive framing solution to consumers or users. Further, this arrangement advantageously can provide an alternative to the protective shoulder concept by using the inner facing peripheries of the mounting of the backing member and the flushing mount therewith to inhibit slippage of the backing member and so that damage to a picture cover or a picture can be inhibited.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION

The present invention now will be described more fully hereinafter with reference to the accompanying drawings in which illustrated embodiments of the invention are shown. This invention, however, may be embodied in many different forms and should not be construed as limited to the illustrated embodiments set forth herein. Instead, these illustrated embodiments are provided so that this disclosure will be thorough and complete and will fully convey the scope of the invention to those skilled in the art. Like numbers refer to like elements throughout.

Figure 1:
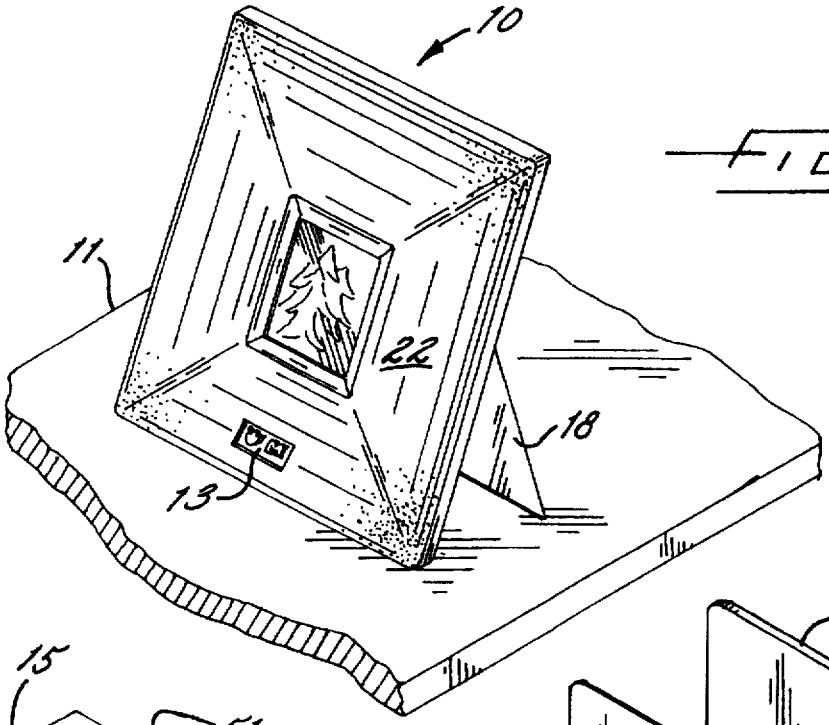
FIG. 1 is a perspective view of a framed picture according to the present invention positioned on a fragmentary portion of desk, table, or shelf.
Figure 2:
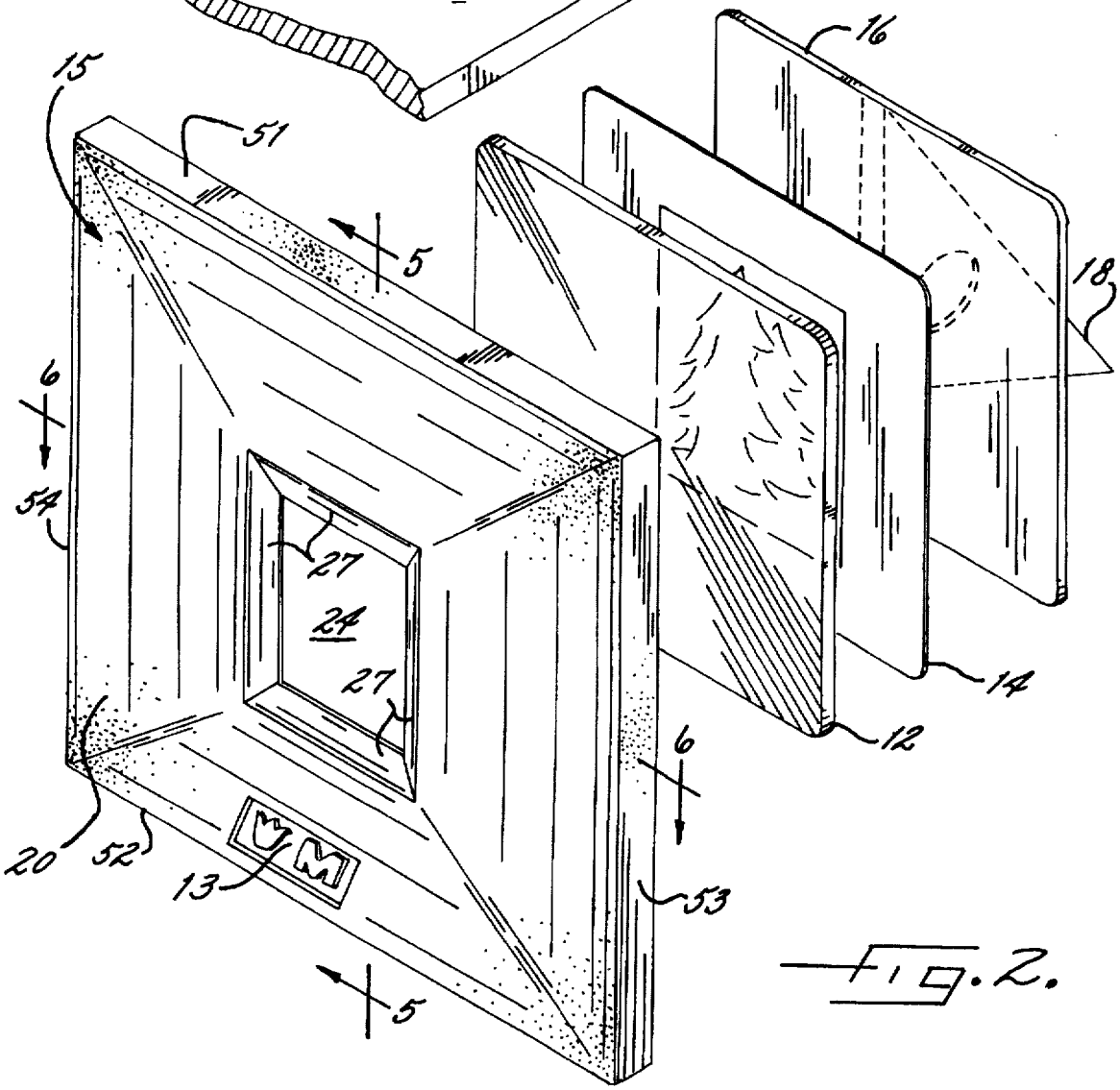
FIG. 2 is an exploded perspective view of a framed picture according to the present invention.
Figure 3:
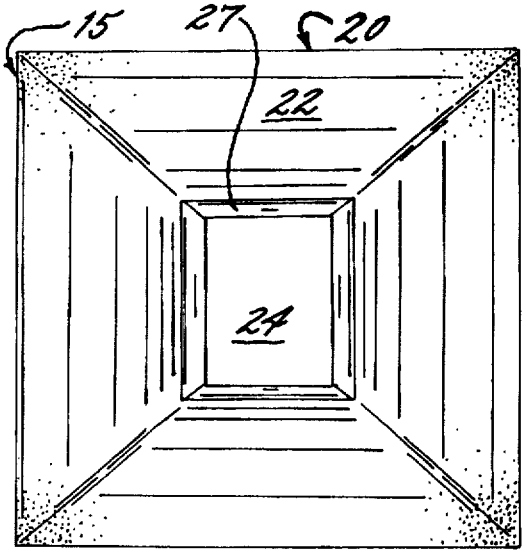
FIG. 3 is a front plan view of a soft, pliable picture frame according to a first embodiment of the present invention.
Figure 4:
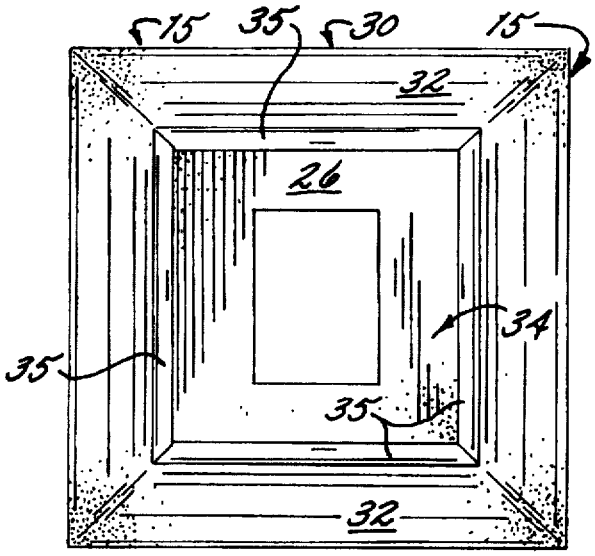
FIG. 4 is a back plan view of a soft, pliable picture frame according to a first embodiment of the present invention.

FIGS. 1–2 illustrate a framed picture 10 according to the present invention arranged to be positioned on a desk, a table, or a shelf 11 for viewing. The framed picture 10 preferably includes a transparent sheet formed of a material such as glass or transparent plastic and defining a picture covering 12. A picture 14 to be viewed or displayed such as a photograph, illustration, or other various artworks is positionally aligned adjacent the picture covering 12 for viewing therethrough and for protecting the picture 14 from damage. A backing sheet member 16 is preferably positioned to underlie back portions of the picture 14 and arranged for supporting front portions of the picture 14 against the picture covering 12. The backing sheet member 16 preferably is formed of pressed paperboard, cardboard, hard plastic, or other rigid material and preferably has peripheral dimensions, i.e., circumference, substantially the same as, or somewhat greater than, the peripheral dimensions of the picture 14 and the picture covering 12. The backing sheet member 16 may also include a pivotally foldable member connected to and vertically extending the substantial height of the backing sheet member 16 so as to define a standing support 18, e.g., triangular-shaped, for supporting the framed picture 10 in an upright position. Other types of mounting or standing support members may also be connected to a frame body 15 or the backing sheet member 16 for mounting the framed picture 10 to a wall or other mounting surface. These other types would also include a double-sided frame body and/or a base member integrally formed or connected to lower end portions of the frame body.

The framed picture 10 also includes a picture frame according to the present invention which has a frame body 15 integrally formed from a unitary piece of a soft, pliable material that preferably encases and detachably secures peripheral portions of the picture covering 12, the picture 14, and the backing sheet member 16 within the confines of the frame body 15. The frame body 15 is preferably integrally formed of a unitary piece of a soft, pliable material, such as a foam material, i.e., polyurethane, or other soft elastomeric material. A soft, pliable elastomeric material such as polyurethane foam would preferably have a durometer range from about 20 DD to about 55 DD. The soft, pliable foam material also may be either open or closed cell foam or a combination thereof. The material further is preferably a thermoset plastic for forming the frame body 15 through a molding process as described further herein. Although the framed picture 10 according to the present invention preferably includes these elements described, it will be understood by those skilled in the art that a framed picture 10 may not necessarily include a picture covering and a backing member. The frame body 15 may be any shape, character, color, or design, such as round, square, oval, animals, trees, or other configurations, but preferably is rectangular so that the picture 14 may be displayed either in portrait or landscape orientation. The frame body 15 also may be texturized or contoured in various configurations as well.

As best illustrated in FIGS. 2–6, the frame body 15 of the soft, pliable picture frame preferably includes front 20 and back 30 portions thereof. The front portion 20 preferably has a first opening 24 formed therein arranged for viewing a picture therethrough. The first opening 24 preferably is positioned in a medial portion of the frame body 15 as illustrated. The back portion 30 has a second opening 34 formed therein positionally aligned with the first opening 24 and arranged to receive 20 a picture covering 12, a picture 14, and a backing sheet member 16 therein. The second opening 34 also preferably is positioned in a medial portion of the frame body 15 as illustrated, but either the first or second opening 24, 34 may also be positioned in various other positions in 25 the frame body 15. It further will be understood by those skilled in the art that frame bodies having at least one opening and/or a plurality of openings therein are also taught by this invention so that at least one picture and/or a plurality of pictures may be displayed 30 or viewed therethrough. The second opening 34 of the back portion 30 preferably has a larger circumference than the first opening 24 as illustrated so that peripheral portions of the body surrounding the first opening 24 and positioned between the first and second openings 24, 34, define a front shoulder 26 to position peripheral portions of a picture covering 12 thereagainst so that a picture 14 when positioned against a picture 9 covering 12 is viewable from the front portion 20 of the frame body 15.

The back portion 30 of the frame body 15 further has a flexible peripheral lip 35 preferably surrounding the second opening 34, positionally aligned with and spaced rearwardly from the front shoulder 26, and encasing and detachably securing peripheral portions of a picture covering 12, a picture 14, and a backing sheet member 16 when positioned within the second opening 34. The back portion 30 also preferably has a ledge 41, i.e., peripheral inner side walls, formed integrally with, positioned generally perpendicular to, and surrounding the front shoulder 26 of the front portion 20 and positioned between the first and second openings 24, 34 so that at least peripheral edges of the backing sheet member 16 positioned within the second opening 34 and between the front shoulder 26 and the lip 35 abuttingly contact the ledge 41. The peripheral dimensions, i.e., circumference, of the picture covering 12 and the picture 14, however, are also preferably large enough also to be encased and secured within the frame body 15 as illustrated.

The flexible peripheral lip 35 of the back portion 30 preferably includes inner portions positioned generally perpendicular to the ledge 41 and generally parallel with, spaced rearwardly from, and aligned with the front shoulder 26 so as to define a back shoulder 36 surrounding the second opening 34 so that a backing sheet member 16 when positioned within the second opening 34 and between the front shoulder 26 and the lip 35 abuttingly contacts the back shoulder 36. The back shoulder 36 preferably has a smaller surface area than the front shoulder 26 for abuttingly contacting the backing sheet member 16 when positioned within the frame 35 body 15 so that a picture covering 12, a picture 14, and a backing sheet member 16 may more easily be encased and detachably secured within the confines of the frame body 15. The flexible peripheral lip 35 surrounding the second opening 34 also preferably includes peripheral outer portions 37 inwardly inclined from outer portions of the second opening 34 toward the back shoulder 36. The inclined outer portions 37 further enable a user of the frame body 15 to easily guide and insert a picture 14 or any combination of the picture covering 12, the picture 14, and the backing sheet member 16 into the second opening 34 and be positioned against, i.e., abuttingly contact, the front shoulder 26, and so as to be retained by the lip 35.

Additionally, outer portions 27 of the frame body surrounding peripheries of the first opening 24 of the front portion 20 preferably are inwardly inclined from the first opening 24 toward the front shoulder 26. The inclined outer portions 27 preferably continuously extend around the entire periphery of the first-opening 24 to thereby increase the angular position from which the picture 14 can be viewed within the frame body 15, allow additional light to reach the picture 14 past the front portion 20, which preferably is generally thicker than a conventional picture frame, and focus a viewers attention toward the picture 14 displayed in the medial portion of the frame body 10.

Figure 5:
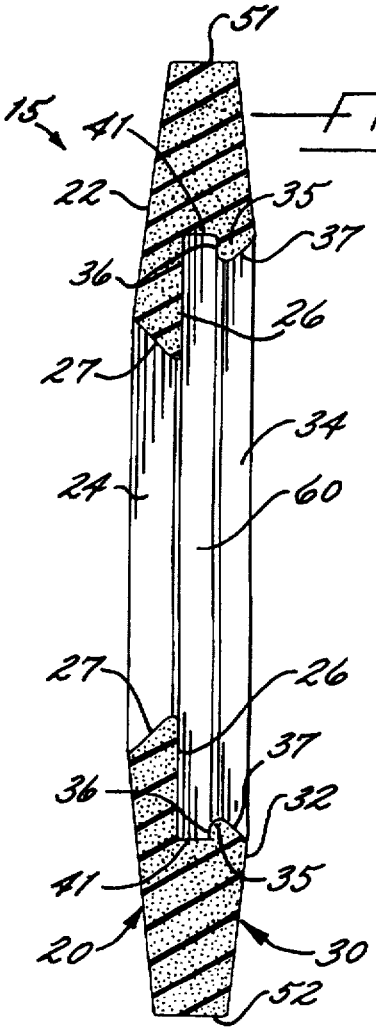
FIG. 5 is a transverse sectional view of a soft,pliable picture frame taken along line 5—5 of FIG. 2.
Figure 6:
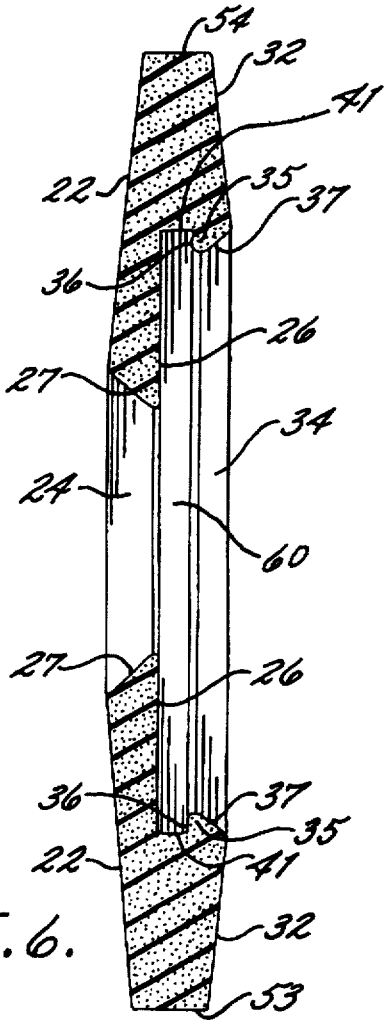
FIG. 6 is a transverse sectional view of a soft, pliable picture frame taken along line 6—6 of FIG. 2.

The ledge 41, the front shoulder 26, and the back shoulder 36 in combination are positioned within inner portions of the frame body 15 preferably to define peripheral portions of a cavity 60, as best shown in FIGS. 5 and 6. The cavity 60 is arranged to receive the picture covering 12, the picture 14 and the backing sheet member 16 therein preferably through the second opening 34. The depth of the cavity 60, i.e., the width of the ledge 41 or the inner peripheral sidewalls, preferably is approximately the same as the combined 35 thickness of the picture covering 12, the picture 14, and the backing sheet member 16. It will be understood by those skilled in the art that the depth of the cavity 60, however, may also approximate only a picture 14 or any combination of a picture covering 12, a picture 14, and a backing sheet member 16.

Also, the frame body 15 preferably is integrally formed by a reaction injection molding ("RIM") process as understood by those skilled in the art. Because the material is preferably a thermoset plastic which cannot be reflowed, the process preferably involves mixing two or more portions of chemicals together in a liquid state 10 to predetermined ratios and pouring the mixture into a cavity of a closed mold. The closed mold is preferably cast from a master high-quality, three dimensional representation of the desired frame body 15 or other frame matting members. It is preferably formed of epoxy, aluminum or steel depending on the total number of parts needed, e.g., the harder the material, the longer the master will last and generate acceptable quality parts. The mold is a negative volume of the desired shape or design that is eventually filled with a polyurethane resin and preferably placed under a heat lamp or the like. A reaction occurs between the chemicals such that heat and expansion occurs whereby the resulting expansion fills the mold with a frame body 15, or frame matting member, having a predetermined density with a predetermined and/or varied durometer. The frame body 15 is then removed from the mold, allowed to cool, and trimmed as necessary. The density and other characteristics of the frame body 15 preferably may vary depending on the type, the expansion ratio, and portion of chemical materials mixed, including by varying the quantity or volume of material poured or injected into the mold cavity. This process also allows the frame body 15 to be texturized and/or include indicia 13, such as a name, insignia, or other 35 artwork, to be integrally formed, i.e., molded, on an outer surface 22 of the frame body 15. This surface is illustrated in FIGS. 1–2 as a front outer surface 22 surrounding the first opening 24 of the front portion 20 of the frame body 15. Other surfaces of the frame body 15, including a back outer surface 32, side outer surfaces 51–54, as well as inner surfaces such as the front or back shoulders 24, 34 may also include various indicia.

As best illustrated in FIGS. 5–6, the respective front and back outer surfaces 22, 32 are also preferably contoured and formed so that peripheral portions of the 10 frame body 15 are thinner than medial portions of the frame body 15 surrounding the front and back shoulders 26, 36 thereof. The front shoulder also has lateral extents greater than lengthwise or vertical extents as illustrated in FIGS. 5 and 6. As well as aesthetic purposes, this configuration also provides strength for the frame body 15 and enables the frame body 15 to be easily handled by 15 a user of the picture frame. It will also be understood by those skilled in the art that some types of injection molded elastomeric materials, i.e., a polymeric material, may also be used according to the present invention.

Figure 7:
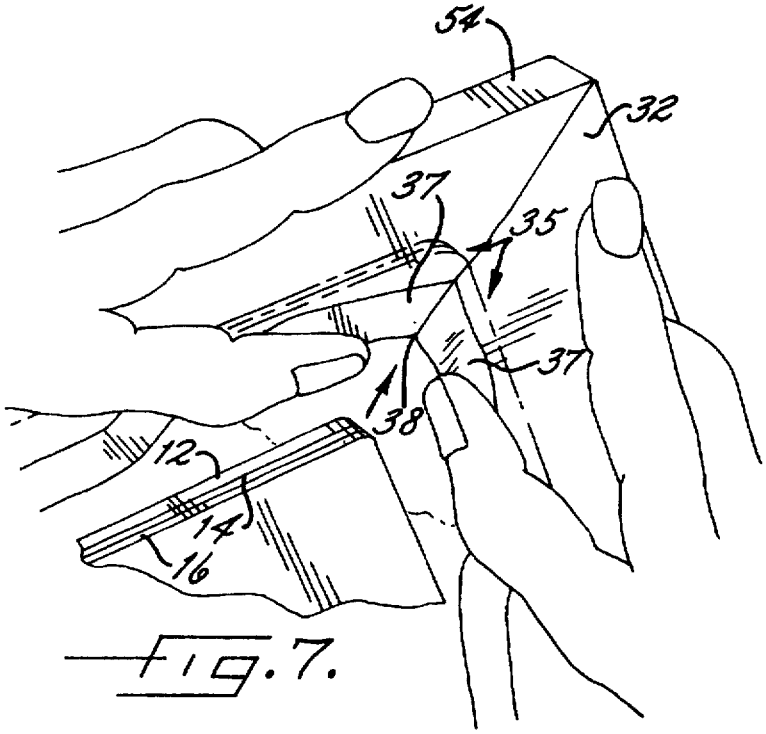
FIG. 7 is framing a picture in a soft, pliable picture frame according to the present invention.

As best shown in FIG. 7, because the frame body 15 is integrally formed of a unitary piece of a soft, pliable material, the frame body 15 generally may be deformed by stretching, twisting, or bending to easily assemble or mount a framed picture 10 with a minimal number of parts. To frame a picture 14, the flexible 25 peripheral portions 35 surrounding the second opening 34 are deformed sufficiently along at least slitted portions 38 formed therein so that the picture covering 12, the picture 14, and the backing sheet member 16 may be inserted between the first and second openings 24, 34 of the frame body 15. With at least a portion of the inclined outer portions 37 of the flexible peripheral portions 35 moved away from a relaxed, non-deformed position, a corresponding peripheral portion of the picture covering 12, the picture 14 and the backing sheet member 16 preferably are inserted into cavity 60 to underlie and to abuttingly contact a corresponding portion of the back shoulder 36. After a peripheral portion of the picture covering 12, the picture 14, and the backing sheet member 16 are inserted into the frame body 15, the flexible peripheral portions 35 are released so that it returns to its relaxed, non-deformed position. This process preferably is repeated until the entire 5 peripheral portions of the picture covering 12, the picture 14, and the backing sheet member 16 are encased in the cavity 60 and within the confines of the frame body 15. The framed picture 10 then may be positioned on a desk, table, shelf 11, or wall so that the picture 14 may be viewed or displayed through the first opening 24.

Figure 8:
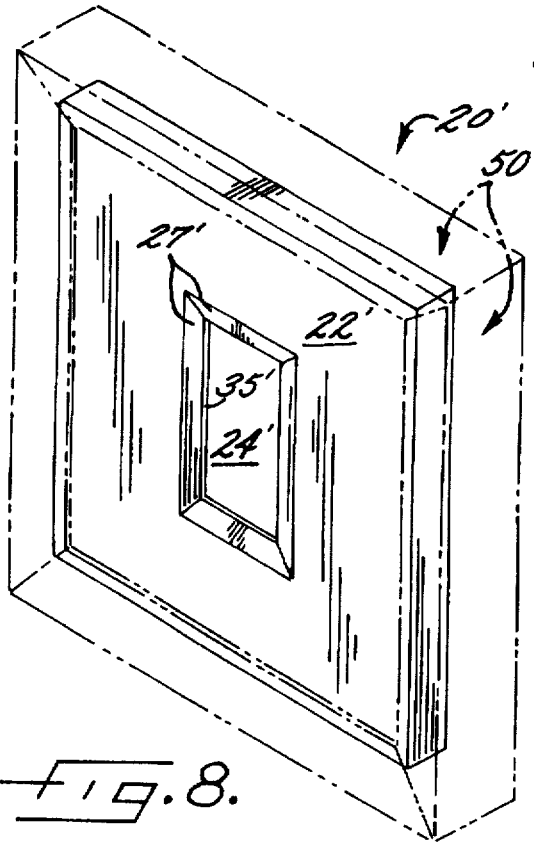
FIG. 8 is a perspective view of a soft, pliable picture frame as a matting frame according to a second embodiment of the present invention.
Figure 9:
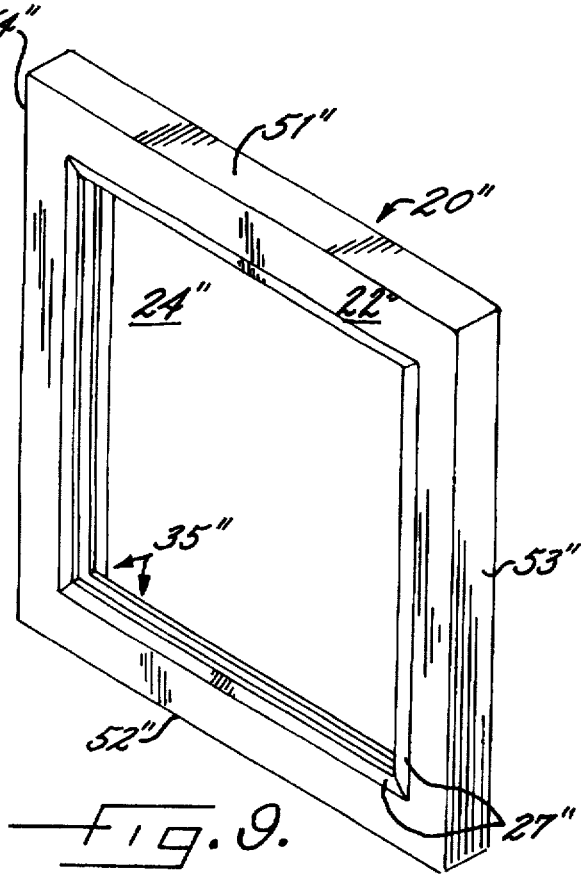
FIG. 9 is a perspective view of a soft, pliable picture frame as a peripheral frame according to a third embodiment of the present invention.

As illustrated in FIGS. 1–13, but as best shown in FIG. 7, methods of framing a picture 14 for protecting a frame from damage such as when knocked over on a desk or table 11, and for detachably securing a picture 14, i.e., within the confines of a frame 15 peripheral portions thereof are also provided by the present invention. A method preferably includes encasing peripheral portions of a picture 14 within the confines of a picture frame 15 integrally formed of a unitary piece of a soft, pliable foam material and which includes at least one opening 24 formed in a front portion 20 thereof so that front portions of the picture 14 correspondingly are viewable through the opening 24 in the front portion 20 of the soft, pliable picture frame. Another method preferably includes providing a frame body 15 integrally formed of a unitary piece of a soft, pliable material and which includes front 20 and back 30 portions. The front portion 20 has a first opening 24 therein and the back portion 30 has a second opening 34 30 therein positionally aligned with the first opening 24. Peripheral portions of the lip 35 of the frame body 15 surrounding the second opening of the back portion are deformed and a picture 14 such as a photograph, illustration, or other various artworks is inserted into the second opening 34 so that peripheral portions of the picture 14 are encased within the confines of the frame body 15 between the first and second openings 24, 34 formed therein. FIGS. 8 and 9 illustrate perspective views of a soft, pliable picture frame 20', 20" according to second and third embodiments of the present invention. Like elements of these embodiments are designated with prime (') and double prime (") notation for clarity purposes. FIG. 8 illustrates a soft, pliable picture frame 20' as a frame matting member having a peripheral frame member 50', as illustrated in broken lines, surrounding peripheral portions of the frame matting member 20'. In other words, instead of merely being a frame as illustrated and described with respect to the first embodiment, this embodiment forms a matting member which, in essence, frames a photograph or picture prior to being mounted into another frame or outer frame member 50'. This embodiment also preferably has the respective front and back shoulders 26', 36' and a flexible lip 35' as described above. FIG. 9 illustrates a soft, pliable picture frame 20" as a peripheral frame member arranged to surround and encase peripheral portions of either individually or in combination a picture covering 12, a picture 14, and a backing member 16 according to a third embodiment of the present invention. This embodiment also preferably has a flexible lip 35" as described above and the methods of framing a picture further include these embodiments as understood by those skilled in the art.

Figure 10:
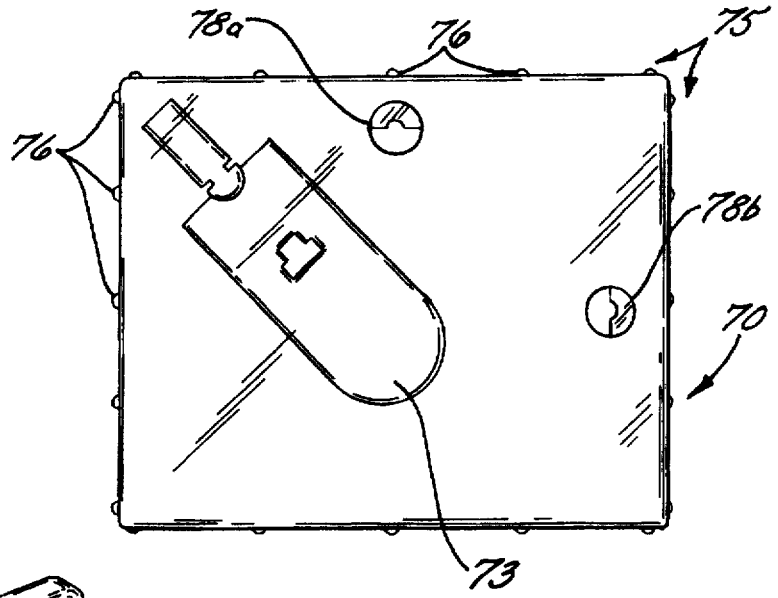
FIG. 10 is a rear plan view of another embodiment of a backing sheet member of a picture frame according to a fourth embodiment of the present invention.
Figure 11:
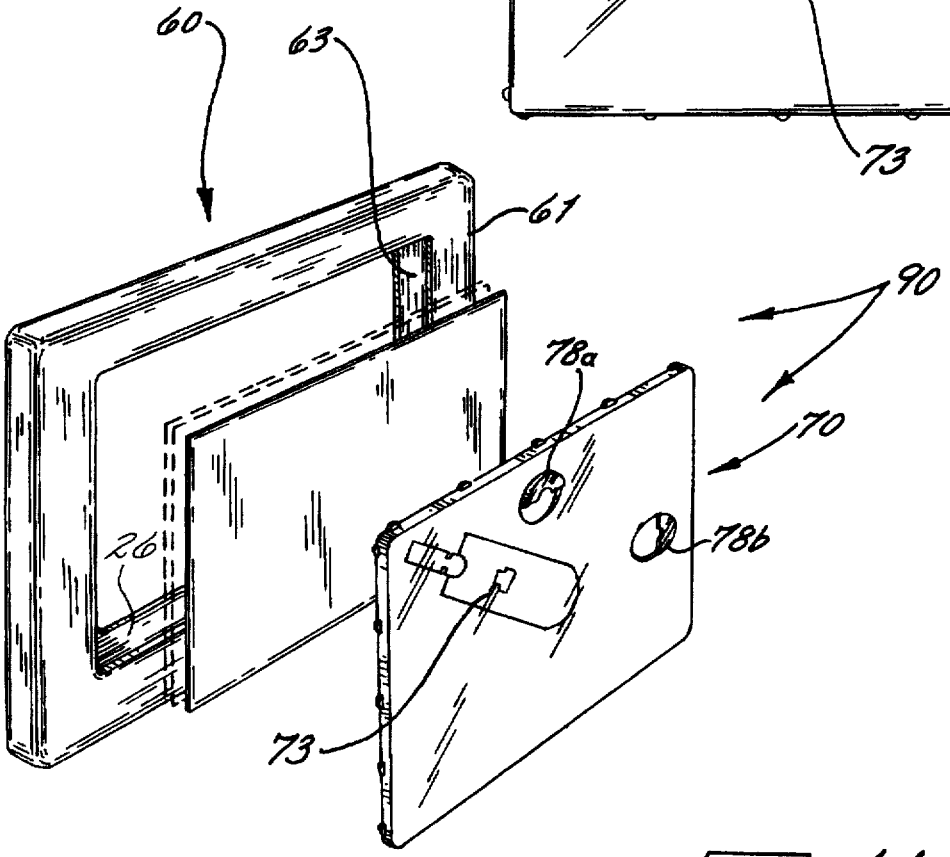
FIG. 11 is an exploded perspective view of the assembly of a picture frame according to a fourth embodiment of the present invention.
Figure 12:
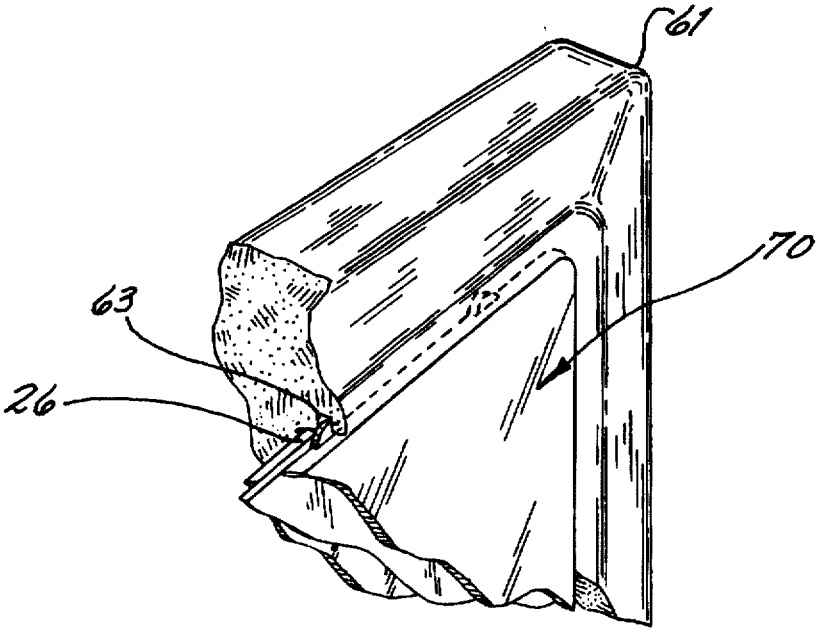
FIG. 12 is a fragmentary perspective view of an assembled picture frame according to a fourth embodiment of the present invention.
Figure 14:
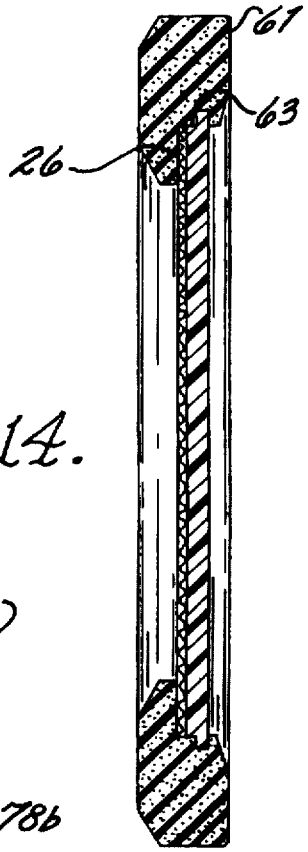
FIG. 14 is a vertical sectional view of a picture frame assembly taken along line 14—14 of FIG. 13 according to a fourth embodiment of the present invention.
Figure 13:
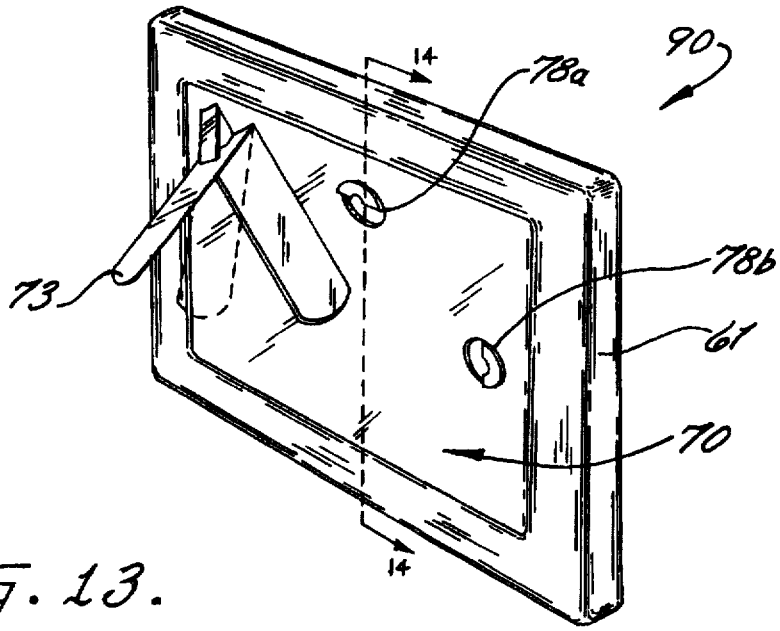
FIG. 13 is a perspective view of an assembled picture frame according to a fourth embodiment of the present invention.

FIGS. 10–14 illustrate a fourth embodiment of a picture frame 60 and a picture frame assembly 90 according to the present invention. In this embodiment, a frame body 61 preferably interfaces with peripheral portions of a backing member 70 as illustrated in FIGS. 10–12. The backing member 70 preferably has backing slippage inhibiting means 75, e.g., a roughened surface such as a plurality of spaced-apart humps 76, connected to vertically and horizontally positioned peripheral edges 71 thereof for inhibiting slippage of peripheral portions of the backing member 70 when positioned within the frame body 61.

As best illustrated in FIG. 12, these plurality of spaced apart humps 76 preferably allow the backing member 70 to be readily positioned within a peripheral back portion of the frame body 61 and inhibit slippage of the backing member 70 when peripheral portions thereof are positioned within the inner confines of the frame body 61, e.g., a gripping or digging into the foam material thereof. The humps 76 preferably form a roughened surface having a large enough size so as to provide a large enough surface area contact with the ledge and lip of the frame body 61 to inhibit the slippage when the surfaces of the humps 76 and the frame body 61 interface. The plurality of humps 76 also advantageously can ease the insertion process and reduce the stress on the flexible lip because only smaller portions or a reduced surface area needs to be inserted into the inner ledge for mounting thereof.

In essence, the frame body 61 can be formed having only one inner ledge 63, in addition to the shoulder 26, so that a picture to be viewed from the frame 60 can be inserted into the inner ledge 63 adjacent the front portion of the frame body 61, and the backing member 70 can be inserted into the shoulder 26 adjacent the back portion of the frame body 61. This type of inner ledge 63 and backing member 70 construction advantageously can allow the picture frame 60 to accommodate a broader range of framed material. Although not preferred from an expense of manufacturing point of view, alternatively a plurality of inner ledges, e.g., a pair, can be formed within the inner confines or inner surfaces of the frame body 61. This embodiment, for example, allows the peripheral edges of the back portion of the frame body to be slightly flexed or deformed for insertion of the backing member without tearing or damaging the foam material, e.g., corners. This fourth embodiment also advantageously provides an alternative mounting configuration that can be used without the slitted portions, or in conjunction therewith, of the other embodiments as described and illustrated herein above.

Preferably, the backing member 70 abuttingly contacts the back surface of a picture to provide an even pressure across the back surface or other backing of the picture. The backing member 70 also preferably has at least one opening, e.g., a pair 78*a*, 78*b*, integrally formed therein such as illustrated to provide portions thereof for gripping and/or hanging the picture frame assembly 90 on a wall or other mounting surface.

Additionally, as illustrated, this backing member 70 is preferably formed of a plastic or polymeric material and can have a stand member 73 connected thereto. This stand member 73 preferably is formed integrally therewith or connected by a living hinge 77 as understood by those skilled in the art. The stand member 73 can be positioned flush with the outer surface of the remaining backing member 70 or can extend outwardly therefrom so as to stand the picture frame assembly 90 upright on a desk. The backing member 70 is also preferably injection molded so that the picture frame assembly 90 will need only two major components, e.g., the frame body 61 and the backing member 70, to accomplish framing of pictures in an attractive and easy process.

This arrangement of the fourth embodiment of a picture frame 60 and assembly 90 provides a secure holding of the picture and backing member 70 within the frame body 61 and advantageously allows the frame body 61 to accommodate a large variety of framed materials. Also, this construction and arrangement can allow matting material or other intermediate backing material for the picture to be eliminated. This advantageously can save costs and provide a less expensive framing solution to consumers or users. Further, this arrangement advantageously can provide an alternative to the protective shoulder concept described above by using the inner facing peripheries of the mounting of the backing member 70 and the flushing mount therewith so that damage to a picture cover or a picture can be inhibited.

This fourth embodiment, for example, also includes methods of framing a picture as described above and as illustrated in FIGS. 1–4, and particularly FIGS. 10–14. A method of framing a picture preferably includes providing a frame body 61 integrally formed of a unitary piece of a soft, pliable elastomeric material and deforming a flexible peripheral lip of the frame body 61 surrounding an opening in a back portion thereof. Peripheral edge portions of a backing member 70 which includes a slippage inhibitor 75 formed integrally therewith are inserted into the inner confines of the frame body 61.

In the drawings and specification, there have been disclosed typical preferred embodiments of the invention, and, although specific terms have been employed, they have been used in a descriptive sense only and not for purposes of limitations. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A picture frame assembly comprising:

a picture;

a backing sheet member positioned to underlie back portions of said picture; and a frame body integrally formed from a unitary piece of soft, pliable foam material, said frame body including front and back portions thereof, said front portion having a first opening formed therein arranged for viewing a picture therethrough, said back portion having a second opening formed therein positionally aligned with said first opening and receiving said picture and said backing sheet member therein and having an inner surface facing said front portion and an outer surface facing away from said front portion, said back portion also having a flexible peripheral lip surrounding said second opening and detachably securing peripheral portions of said picture and said backing sheet member within said second opening and slitted portions formed in an outer surface of said flexible peripheral lip and extending therethrough to the inner surface of said back portion for deforming said lip during insertion of said picture and said backing member.

2. A picture frame assembly as defined in claim 1, wherein the inner surface of said back portion of said frame body includes inner side walls defining a ledge, said ledge being formed integrally with, positioned generally perpendicular to, and surrounding inner surfaces of said front portion and positioned between said first and second openings so that at least peripheral edges of said backing sheet member positioned within said second opening and between the inner surfaces of said front portion and said lip abuttingly contact said ledge, and wherein said backing sheet member includes slippage inhibiting means connected to peripheral edges of said backing member for inhibiting slippage of peripheral portions of said backing member when positioned within said frame body and abuttingly contacting said ledge.

3. A picture frame assembly as defined in claim 1, wherein said frame body is integrally formed of a unitary piece of soft, pliable elastomeric material having a durometer from about 20 DD to about 55 DD.

4. A picture frame assembly as defined in claim 1, wherein said front portion of said frame body further has indicia integrally molded with the outer surface thereof.

5. A picture frame constructed for more easily mounting a picture therein, the picture frame comprising:

a body integrally formed of a unitary piece of soft, pliable foam material having a durometer in the range of about 20 DD to about 55 DD, said body including front and back portions thereof, said front portion having a first opening formed therein arranged for viewing a picture therethrough, and said back portion having a second opening formed therein positionally aligned with said first opening and arranged for receiving at least a backing sheet member therein and having an inner surface facing said front portion and an outer surface facing away from said front portion, said back portion also having a flexible peripheral lip surrounding said second opening and adapted for detachably securing peripheral portions of at least a backing sheet member when positioned within said second opening, said flexible peripheral lip having slitted portions formed in an outer surface thereof and extending therethrough to the inner surface of said back portion to release stress on said flexible peripheral lip when deforming said lip during insertion of the at least a backing member.

6. A picture frame as defined in claim 5, wherein the inner surface of said back portion of said frame body includes inner side walls defining a ledge, said ledge being formed integrally with, positioned generally perpendicular to, and surrounding inner surfaces of said front portion and positioned between said first and second openings so that at least peripheral edges of a backing sheet member when positioned within said second opening abuttingly contact said ledge.

7. A picture frame as defined in claim 6, wherein said front portion of said frame body further includes indicia integrally formed on the outer surface thereof.

8. A picture frame assembly comprising:

a frame body integrally formed from a unitary piece of soft, pliable foam material, said frame body including front and back portions thereof and an opening formed so as to extend from the front portion to the back portion thereof, said back portion having a flexible peripheral lip surrounding said opening; and a backing member having peripheral portions thereof inserted into said frame body for supporting a picture to be viewed through said opening from a front portion thereof, said backing member including slippage inhibiting means connected to peripheral edges of said backing member for inhibiting slippage of peripheral portions of said backing member when positioned within said frame body.

9. A picture frame assembly as defined in claim 8, wherein said slippage inhibiting means of said backing member includes a non-planar roughened surface extending around peripheral edges of said backing member.

10. A picture frame assembly as defined in claim 9, wherein the non-planar roughened surface comprises a plurality of spaced-apart humps connected to and integrally formed with peripheral edges of said backing member.

11. A method of framing a picture comprising:

providing a frame body integrally formed of a unitary piece of a soft, pliable foam elastomeric material having a durometer in the range of about 20 DD to about 55 DD;

deforming a flexible peripheral lip of the frame body surrounding an opening in formed in the frame body, the frame body also including an inner surface and an outer surface substantially surrounding the inner surface, the flexible peripheral lip including a slitted portion formed in an outer surface thereof and extending therethrough to the inner surface; and inserting a picture into the opening so that peripheral portions of the picture are detachably secured within the confines of the frame body.

12. A method of framing a picture comprising:

providing a frame body integrally formed of a unitary piece of a soft, pliable elastomeric material;

deforming a flexible peripheral lip of the frame body surrounding an opening in a back portion thereof; and inserting peripheral edge portions of a backing member which includes a non-planar slippage inhibitor formed integrally therewith into the inner confines of the frame body.

* * * * *